United States Patent [19]

Armini et al.

[11] Patent Number: 4,477,921

[45] Date of Patent: Oct. 16, 1984

[54] X-RAY LITHOGRAPHY SOURCE TUBE

[75] Inventors: Anthony J. Armini, Bedford; Wallace S. Kreisman, Malden, both of Mass.

[73] Assignee: Spire Corporation, Bedford, Mass.

[21] Appl. No.: 325,286

[22] Filed: Nov. 27, 1981

[51] Int. Cl.[3] ..... G21K 5/00

[52] U.S. Cl. ..... 378/34; 378/141; 378/143

[58] Field of Search ..... 378/34, 35, 143, 144, 378/141

[56] References Cited

U.S. PATENT DOCUMENTS

| | | | |
|---|---|---|---|
| 3,742,229 | 6/1973 | Smith et al. | 250/65 R |
| 3,742,230 | 6/1973 | Speers et al. | 250/65 R |
| 3,743,842 | 7/1973 | Smith et al. | 250/320 |
| 3,974,382 | 8/1976 | Bernacki | 250/327 |
| 3,984,680 | 10/1976 | Smith | 250/272 |
| 4,201,580 | 5/1980 | Feit | 430/319 |
| 4,215,192 | 7/1980 | Buckley | 430/270 |
| 4,238,706 | 12/1980 | Yoshihara | 378/34 |
| 4,258,262 | 3/1981 | Maldonado | 378/34 |
| 4,262,083 | 4/1981 | Pampaloue et al. | 430/296 |

OTHER PUBLICATIONS

J. L. Gaines et al., "An Improved Annular Shaped Electron Gun for an X-Ray Generator", *Nuclear Instruments and Methods*, 126 (1975), pp. 99–101.

J. R. Maldonado, "X-Ray Lithography Source Using a Stationary Solid Pd Target", J. Vac. Sci. Tech., 16(6), Nov./Dec. 1979, pp. 1942–1945.

*Primary Examiner*—Craig E. Church

*Attorney, Agent, or Firm*—Morse, Altman & Dacey

[57] ABSTRACT

A composite target cone for use in an X-ray lithography source tube. The composite target cone is multi-layered, having at least an X-ray generating layer formed of platinum, silver, palladium, rhodium, molybdenum, tungsten, silicon, aluminum or copper, and a water-interface layer. The water-interface layer includes a layer of high thermal conductivity material, covered at one side by a layer of high corrosion resistance material and at the other side by a layer of high-melting point material.

9 Claims, 2 Drawing Figures

X-RAY LITHOGRAPHY SOURCE TUBE

BACKGROUND OF THE INVENTION

1. Field of the Invention

The present invention relates generally to X-ray lithography apparatus and, more particularly, to an X-ray lithography source tube of the type comprising an electron beam source and a target for generating X-rays wherein the target is in the form of a composite target cone comprising at least an X-ray generating layer and a water-interface layer.

2. Prior Art

Large-scale integrated (LS1) circuits and, more recently, very-large-scale integrated (VLS1) circuits have been developed, among others, to cut costs. In the beginning, light in the visible range and ultraviolet radiation have been employed in a process known as photolithography. Soon thereafter, the electron beam came into widespread use in the manufacture of microelectronic circuits and masks because of its higher resolution than that obtainable with light. The higher resolution of the electron beam is at least partially due to the fact that it can be more precisely focused than can a light beam. With the need for still better resolution in the manufacture of VLS1 circuits, the use of X-ray radiation has been developed in a process known as X-ray lithography. See U.S. Pat. Nos. 3,742,229; 3,742,230; 3,743,842; 3,974,382; 3,984,680 and 4,287,235; each assigned to the Massachusetts Institute of Technology. The use of X-rays permits the use of much shorter wave lengths, typically below about ten angstroms (Å), than those found in the ultraviolet region, typically about 3,000 to about 4,000 angstroms.

An X-ray lithography apparatus essentially comprises an X-ray generator, including a target, and a processing chamber. For a typical design of an X-ray generator, see the article "An Improved Annular-Shaped Electron Gun for an X-ray Generator" by J. L. Gaines and R. A. Hansen, *Nuclear Instruments and Methods* 126 (1975) pp. 99–101. As known, electrons, produced at the cathode by an electrically heated filament, are accelerated towards and strike the target. At the target, a small percentage of the energy of the electron beam is converted into X-radiation. The remaining, and much larger percentage of the energy of the electron beam striking the target is converted to heat, however. Hence, the target must be cooled, preferably by water, all the time that the X-ray generator is in operation. For a typical design of an X-ray generator featuring a target cooled by a high velocity flow of water, see the article "X-ray Lithography Source Using a Stationary Solid Pd Target" by J. R. Maldonado et al., *J. Vac. Sci. Technol.*, Vol. 16, No. 6, Nov./Dec. 1979, pp. 1942–1945. As mentioned in this article, currently commercially available X-ray generators for use in lithographic systems have been plagued by maintenance and reliability problems. Some of these problems find their genesis in the shape, construction and choice of material for the target. These problems are continuing.

There is thus a need for an improved target for use in X-ray lithographic systems.

SUMMARY OF THE INVENTION

It is a principal object of the present invention to overcome the above problems by providing an improved X-ray lithography source tube featuring a target of composite construction and characterized by good reliability, extended lifetime and low maintenance.

More specifically, it is an object of the present invention to provide, in an X-ray lithography source tube of the type comprising an electron beam source and a watercooled target for generating X-rays, a composite target cone comprising at least an X-ray generating layer and a water-interface layer. Preferably, the X-ray generating layer is formed of a member of the class consisting of platinum, silver, palladium, rhodium, molybdenum, tungsten, silicon, aluminum and copper. Preferably, the water-interface layer includes a layer of high thermal conductivity material, covered at one side by a layer of corrosion resistant material and at the other side by a layer of high-melting point material.

Other objects of the present invention will in part be obvious and will in part appear hereinafter.

The invention accordingly comprises the X-ray lithography source tube of the present disclosure, its components, parts and their interrelationships, the scope of which will be indicated in the appended claims.

BRIEF DESCRIPTION OF THE DRAWINGS

For a fuller understanding of the nature and objects of the present invention, reference is to be made to the following detailed description, which is to be taken in connection with the accompanying drawings, wherein.

DETAILED DESCRIPTION OF THE PREFERRED EMBODIMENT

Figure 1:
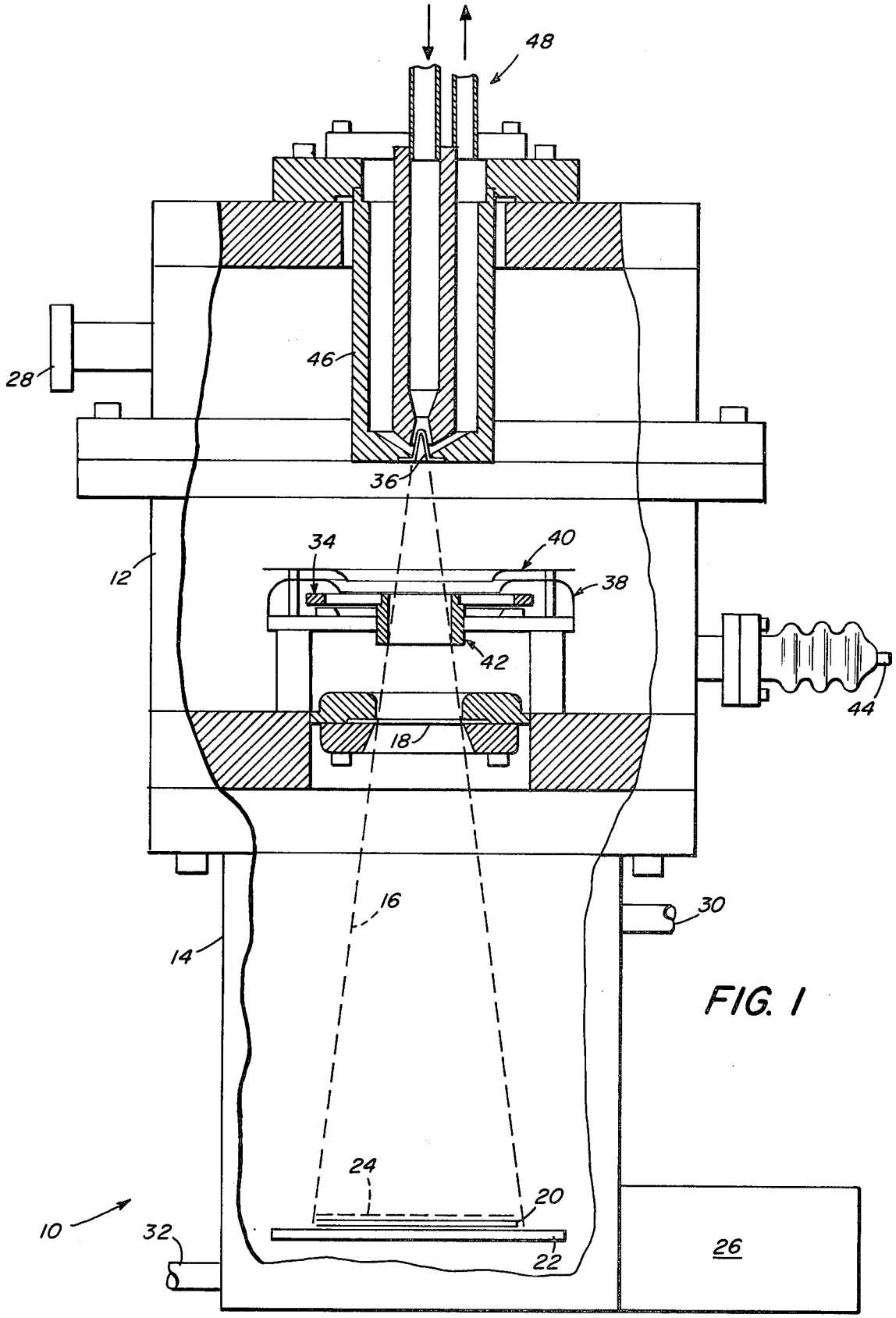
FIG. 1 is a schematic sectional elevation, with parts broken away, of an X-ray lithography apparatus constructed in accordance with and embodying the present invention.

Generally, the illustrated embodiment of an apparatus 10 for use in X-ray lithographic systems for the manufacture of LS1 and VLS1 circuits, or for X-ray lithography research, comprises a high intensity, soft X-ray lithography source tube 12 and a processing chamber 14 mounted in operative associated therewith. Soft X-ray radiation 16, generated in the well-shielded tube 12, is permitted to escape therefrom only through a window 18, preferably formed of beryllium. The beryllium window 18 separates, in an airtight manner, the X-ray lithography source tube 12 from the processing chamber 14. The X-ray radiation 16 escaping the tube 12 through the window 18 is designed to operate on a work, such as a wafer 20, deposited on a work support 22, with the radiation 16 passing through a suitable mask 24, as known. See U.S. Pat. Nos. 3,742,229 and 3,742,230, mentioned above and assigned to M.I.T. See also U.S. Pat. No. 4,215,192, Buckley, "X-ray Lithography Apparatus and Method of Use," granted July 29, 1980. Preferably, the processing chamber 14 is evacuated and/or filled with an inert gas, such as for example helium, lest the soft X-ray radiation 16 becomes attenuated in air. Soft X-rays are of poorer penetrating power when compared to traditional X-rays. A source of vacuum 26 is shown provided adjacent the processing chamber 14 for evacuating both the chamber 14 and the tube 12, the latter via a suitable hose 28. Inert gas, such as helium, is shown admitted to the chamber 14 via a tube 30 and exiting therefrom via a port 32.

The X-ray lithography source tube 12 essentially comprises an electron beam source 34 and a watercooled target 36. Preferably, the electron beam source 34 is a barium impregnated tungsten ring provided with a shield grid 38 and an extraction grid 40. A beam focus tube 42 is positioned concentrically within the electron beam source 34 so as to limit the range of the electron beam spot size on the target 36. Further adjustment in the electron beam spot size on the target 36 is made by varying the voltage applied to the beam focus tube 42. A high-voltage feedthrough 44 provides the power for operating the electron beam source 34, the grids 38 and 40, and the beam focus tube 42.

Figure 2:
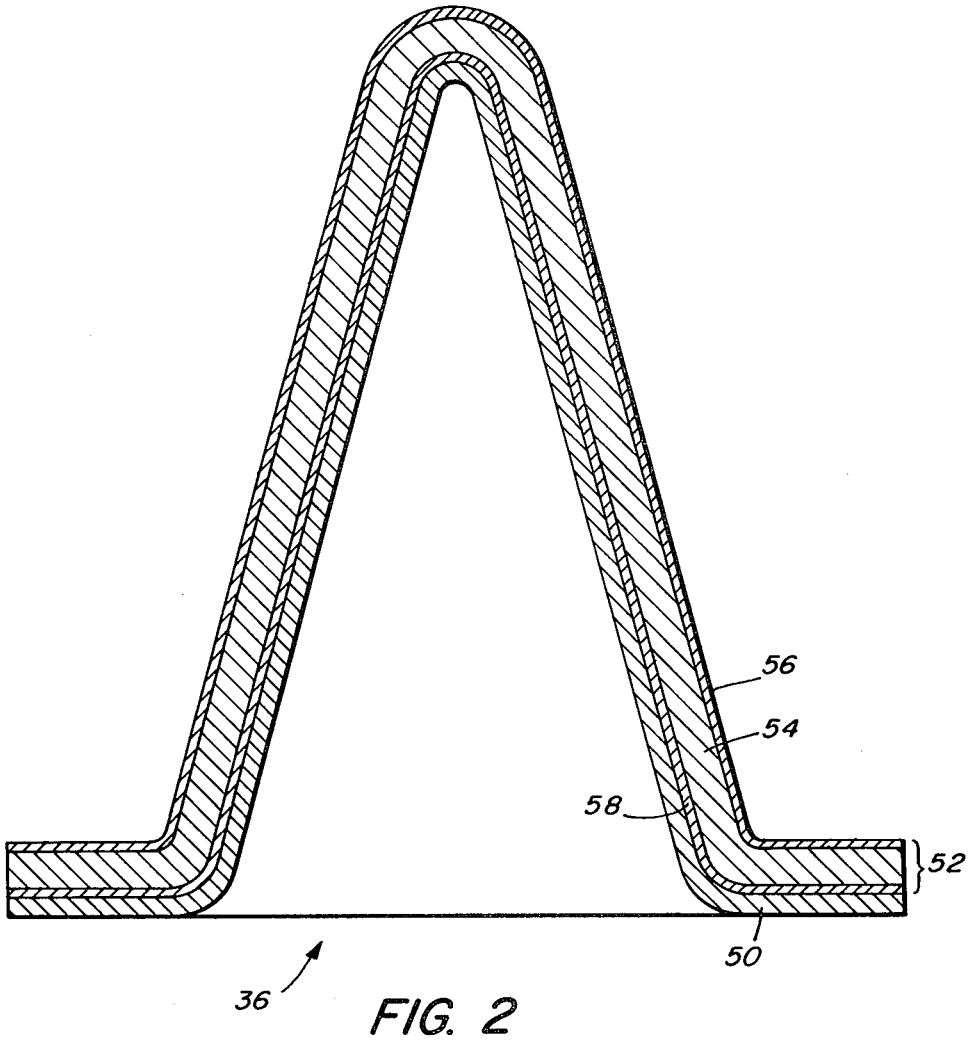
FIG. 2 is a longitudinal section of a composite target cone, on a much enlarged scale, for use in the X-ray lithography apparatus of FIG. 1.

The water cooled target 36 preferably is shaped as an inverted cone, and is multi-layered, as will be more fully described below and with particular reference to FIG. 2. The target 36 is concentrically mounted, and axially displaced from the ring-shaped electron beam source 34, within a suitable jacket assembly 46. Preferably, the jacket assembly 46 is removably secured within the X-ray lithography source tube 12 so as to facilitate the inspection, and exchange if need be, of the target 36. A water inlet-outlet tube assembly 48 is concentrically, and removably, mounted within the jacket assembly 46. Tube assembly 48 is provided to direct a high velocity water flow at the target 36 during the operation of the X-ray lithography apparatus 10.

As mentioned and known, an electron beam from the ring-shaped electron beam source 34 is designed to strike the target 36. See the article by J. S. Gaines and R. A. Hansen, quoted above. The impact of the electrons on the target 36 causes some X-ray emission therefrom just because of the sudden deceleration of the electrons when they collide with free electrons in the target material. This bremsstrahlung (meaning "braking radiation" in German) is not as intense, however, as is the X-ray emission emanating directly from the atoms of the target 36 material. This latter X-ray emission occurs when an electron in one of the innermost orbits of the target atom is literally "knocked out" of the target atom by a high energy electron emanating from the electron beam source 34. An electron from the next lowest orbit of the target atom immediately takes the place of the knocked-out missing electron. This change of orbit by the electron in the target atom causes energy to be released from the target 36 as electromagnetic radiation of a particular wavelength, also referred to as line emission. For the inner electrons of atoms with a high atomic number, this radiation is at X-ray wavelength. The X-ray wavelength region is generally divided between a short X-ray radiation band (about 0.5 to about two Angstroms wavelengths) and a soft X-ray radiation band (about two Angstroms to about 100 Angstroms wavelength). In general, shorter wavelength X-rays are less easily absorbed and are, therefore, more penetrating than soft X-rays. Each metal target 36 element possesses a characteristic X-ray spectrum. This characteristic X-ray spectrum may be in the K-region, as for instance a target 36 formed of aluminum, producing K-line radiation; or it may be in the M-region, as for instance a target 36 formed of tungsten, producing M-line radiation; or it may be in the L-region, as for instance a target 36 formed of palladium, producing L-line radiation.

A designer of X-ray lithography apparatus is faced, among others, with various hurdles in his quest to come up with an apparatus that has high stability, long lifetime and is relatively maintenance free. With specific respect to designing a target anode, the designer knows that the target must be capable of sustained high intensity operation. This suggests the selection and use of a relatively high-melting-point material. However, the designer also knows that the choice of the target anode material is dictated, for the most part, by its characteristic X-ray emission wavelength, which differs from one target material to the next. This is so since the selected characteristic X-ray emission wavelength for the target anode must also be compatible with the mask 24 and the resist materials used in the X-ray lithographic system. See the above-quoted article by Maldonado et al. The designer also strives to obtain as short an exposure time, and thus to achieve a longer life for the target anode, as he can for the particular resist material used in his X-ray lithographic system. See the above-quoted U.S. Pat. No. 4,215,192 to Buckley.

Prompted by these and other design considerations, we have discovered that the multi-layered composite target cone 36 provides the most-desired attributes in terms of high stability, long lifetime, low maintenance and expected short exposure time to the X-ray lithographic apparatus 10 of the invention. A longitudinal section of the multi-layered composite target cone 36 is shown on an enlarged scale in FIG. 2. The composite target cone 36 comprises at least an X-ray generating layer 50 and a water-interface layer 52. The X-ray generating layer 50 preferably is about five micrometers thick and is formed of a member of the class consisting of platinum, silver, palladium, rhodium, molybdenum, tungsten, silicon, aluminum and copper. The methodology of selecting the specific member of this class for the layer 50 will be more fully discussed below.

The water-interface layer 52 of the composite target cone 36 is the layer in contact with the cooling water. Here, good thermal contact with the cooling water and high thermal conductivity to the cooling water are of paramount consideration. We consider that best results overall are achieved by selecting for the bulk of the water-interface layer 52, a layer of high thermal conductivity material 54, which preferably is about fourteen mil thick and preferably is formed of copper or silver. Furthermore, this layer of high thermal conductivity material 54 preferably is covered at the water contacting surface by a thin layer 56 of high corrosion resistance, such as a palladium layer of about several micrometers thickness. This thin layer 56 of high corrosion resistance serves to protect the layer 54 of high thermal conductivity from the nucleate boiling effect of the high velocity turbulent cooling water flowing along the backside of the composite target cone 36. We have also found it advantageous to have a further thin layer 58 of a high-melting-point material, such as for instance a 0.2 micrometer thick layer of tantalum, covering the layer 54 of high thermal conductivity material and facing the X-ray generating layer 50. This layer 58 of high-melting-point material serves to protect the layer 54 of high thermal conductivity material from the adverse effects of the very high working temperatures to which the composite target cone 36 gets exposed on the electron beam side. The composite target cone 36, constructed as above described, does not suffer from interdiffusion between the layers and exhibits no cracking problems despite prolonged use.

Table 1 provides some calculated performance data, based on experimental work, for the different target elements used as an X-ray generating layer 50 in the composite target cone 36 of the X-ray lithography apparatus 10 of the invention. The electron beam source 34 was a barium-impregnated tungsten ring designed to develop a 10 KW electron beam on the target 36, the X-ray window 18 a one mil thick disk of ¾" diameter, the X-ray beam 16 take-off angle was 12.5°, the X-ray lithography source tube 12 was evacuated to a pressure of $1\times10^{-7}$ torr, the composite target cone 36 cooled by water at an input water pressure of about 160 psi @ 4 gal/min, and the applied power was: acceleration=20 KV @ 500 mA, cathode filament=20 V @ 10 amp, extractor grid=1 KV @ 30 mA, and the focus tube=3 KV @ 5 mA.

Column four of Table 1 shows the radiant intensity, I, from each target element when forming the X-ray generating layer 50 of the composite target cone 36. The radiant intensity, I, is stated in milliwatts per steradian.

Column five of Table 1 shows, for each target element forming the X-ray generating layer 50, the expected exposure time, $T_E$, for PMMA resist. It is to be understood that these exposure times vary considerably for resists faster than PMMA. For example, when using PBS resist and aluminum, palladium or rhodium as the target element forming the X-ray generating layer 50 of the composite target cone 36, exposure times under two minutes have been achieved. The exposure time, $T_E$, equals $Q_A/(\Phi_S\alpha)$, WHERE $Q_A$ is 575 J/CM$^3$, and $\Phi_S$ is the radiant flux density (irradiance) of the resist surface, measured in microwatts per square centimeter, and $\alpha$ is the absorption coefficient of the resist in cm$^{-1}$.

TABLE 1

X-RAY LITHOGRAPHY TARGET ELEMENT COMPARISON

| TARGET ELEMENT | CHARACTERISTIC EMISSION WAVELENGTH Å | THERMAL CONDUCTIVITY W/CM/°C. | RADIANT INTENSITY, I MW/SR @ 10 KW | EXPOSURE TIME, $T_E$ MIN |
|---|---|---|---|---|
| PT(L) | 1.31 | 0.697 | 229 | 3233 |
| AG(L) | 4.15 | 4.18 | 161 | 222 |
| PD(L) | 4.37 | 0.705 | 152 | 211 |
| RH(L) | 4.60 | 0.879 | 148 | 196 |
| MO(L) | 5.41 | 1.45 | 111 | 200 |
| W(M) | 6.98 | 1.99 | 19.6 | 416 |
| SI(K) | 7.13 | 0.216 | 182 | 41 |
| AL(K) | 8.34 | 2.15 | 116 | 46 |
| CU(L) | 13.36 | 4.59 | 12 | 287 |

The use of the composite target cone 36 permits, as mentioned, the ready exchange of one target element for another when working with different resist and mask materials.

Thus it has been shown and discribed an X-ray lithography apparatus 10, featuring a composite target cone 36 in an X-ray lithography source tube 12 of the apparatus 10, which apparatus satisfies the objects and advantages set forth above.

Since certain changes may be made in the present disclosure without departing from the scope of the present invention, it is intended that all matter described in the foregoing specification or shown in the accompanying drawings, be interpreted in an illustrative and not in a limiting sense.

What is claimed is:

1. In an X-ray lithography source tube of the type comprising an electron beam source and a target for generating X-rays, wherein the electron beam source is a ring-shaped shielded cathode and the target is a water-cooled inverted cone: the improvement in which said target is in the form of a composite target cone comprising at least an X-ray generating layer and a water-interface layer; wherein said water-interface layer includes a layer of high thermal conductivity material covered at said water-interface layer by a layer of high corrosion resistance material; and wherein said layer of high thermal conductivity material is formed of copper and said layer of high corrosion resistance material is formed of palladium.

2. The X-ray lithograph source tube of claim 1 wherein said X-ray generating layer is formed of a member of the class consisting of platinum, silver, palladium, rhodium, molybdenum, tungsten, silicon, aluminum and copper.

3. The X-ray lithography source tube of claim 1 being characterized by having a high radiant intensity and by being a soft tube, wherein said high radiant intensity is at least one hundred milliwatts per steradian at 10 kw input power.

4. In an X-ray lithography source tube of the type comprising an electron beam source and a target for generating X-rays, wherein the electron beam source is a ring-shaped shielded cathode and the target is a water-cooled inverted cone: the improvement in which said target is in the form of a composite target cone comprising at least an X-ray generating layer and a water-interface layer, wherein said water-interface layer includes a layer of high thermal conductivity material covered at said water-interface layer by a layer of high corrosion resistance material, and wherein said water-interface layer further includes a layer of high-melting-point material covering said layer of high thermal conductivity material and facing said X-ray generating layer.

5. The X-ray lithography source tube of claim 4 wherein said layer of high-melting point material is formed of tantalum.

6. The X-ray lithograph source tube of claim 5 wherein said X-ray generating layer is about five micrometer thick, said layer of high thermal conductivity mate-ial is about fourteen mil thick, said layer of high corrosion resistance material is about one micrometer thick, and said layer of high-melting point material is about 0.2 micrometer thick.

7. An X-ray lithography apparatus comprising:

(a) an X-ray lithography source tube including an electron beam source and a target for generating X-rays, said tube maintained under pressure by a source of vacuum;

(b) a processing chamber mounted in operative association with said X-ray lithography source tube and including a mask and a work support, said chamber also maintained under pressure by said source of vacuum;

(c) said target being a composite target cone including an X-ray generating layer and a water-interface layer;

(d) said X-ray generating layer being formed of a member of the class consisting of platinum, silver, palladium, rhodium, molybdenum, tungsten, silicon, aluminum and copper;

(e) wherein said water-interface layer includes a layer of high thermal conductivity material covered at said water-interface layer by a layer of high corrosion resistance material, and wherein said water-interface layer further includes a layer of high thermal conductivity material and facing said X-ray generating layer.

8. The X-ray lithography apparatus of claim 7 wherein said layer of high thermal conductivity material is formed of copper and said layer of high corrosion resistance material is formed of palladium, and wherein said layer of high-melting point material is formed of tantalum.

9. The X-ray lithography apparatus of claim 8 wherein said X-ray generating layer is about five micrometer thick, said layer of high thermal conductivity material is about fourteen mil thick, said layer of high corrosion resistance material is about one micrometer thick, and said layer of high-melting point material is about 0.2 micrometer thick.

* * * * *